US009196996B2

(12) United States Patent
Kim et al.

(10) Patent No.: US 9,196,996 B2
(45) Date of Patent: Nov. 24, 2015

(54) SAFE OUTLET

(71) Applicants: Jong Il Kim, Seoul (KR); Kyoung Tae Kim, Seoul (KR)

(72) Inventors: Jong Il Kim, Seoul (KR); Kyoung Tae Kim, Seoul (KR)

( * ) Notice: Subject to any disclaimer, the term of this patent is extended or adjusted under 35 U.S.C. 154(b) by 0 days.

(21) Appl. No.: 14/510,319

(22) Filed: Oct. 9, 2014

(65) Prior Publication Data

US 2015/0104960 A1 Apr. 16, 2015

(30) Foreign Application Priority Data

Oct. 10, 2013 (KR) ..... 10-2013-0120450

(51) Int. Cl.
*H01R 13/44* (2006.01)
*H01R 13/453* (2006.01)
*H01R 25/00* (2006.01)

(52) U.S. Cl.
CPC ..... *H01R 13/4532* (2013.01); *H01R 25/003* (2013.01)

(58) Field of Classification Search
CPC ..... H01R 13/4532
See application file for complete search history.

(56) References Cited

U.S. PATENT DOCUMENTS

| | | | | |
|---|---|---|---|---|
| 6,764,322 | B1 * | 7/2004 | Yu | 439/137 |
| 8,584,412 | B2 * | 11/2013 | Frecska et al. | 52/220.6 |
| 2004/0009689 | A1 * | 1/2004 | Wang | 439/139 |
| 2005/0202689 | A1 * | 9/2005 | Kim et al. | 439/43 |
| 2015/0104960 | A1 * | 4/2015 | Kim et al. | 439/131 |

FOREIGN PATENT DOCUMENTS

| | | |
|---|---|---|
| KR | 10-1996-0036207 | 10/1996 |
| KR | 20-0192441 | 9/2000 |

* cited by examiner

*Primary Examiner* — James Harvey
(74) *Attorney, Agent, or Firm* — Kile Park Reed & Houtteman PLLC

(57) ABSTRACT

Provided in a safe outlet further including a rotary type locking body in which the rotary type locking body falls down when a plug is not plugged into the outlet, to thereby make outlet terminals not opened, to thus prevent an electric shock accident in advance, and to thereby entirely block foreign substances such as dust from entering an earth terminal hole.

3 Claims, 7 Drawing Sheets

SAFE OUTLET

CROSS-REFERENCE TO RELATED PATENT APPLICATION

This application claims the benefit of Korean Patent Application No. 10-2013-0120450, filed on Oct. 10, 2013, in the Korean Intellectual Property Office, the disclosure of which is incorporated herein in its entirety by reference.

BACKGROUND OF THE INVENTION

1. Field of the Invention

The present invention relates to a safe outlet, and more particularly to a safe outlet having a rotary type locking body in which the rotary type locking body falls down when a plug is not plugged into the outlet, to thereby make outlet terminals not opened, to thus prevent an electric shock accident in advance, and to thereby entirely block foreign substances such as dust from entering an earth terminal hole.

2. Description of the Related Art

Generally, in order to receive electricity generated and supplied from electric power plants and to use household electrical appliances at homes, burial type outlets are provided for an electrical power supply on the walls of homes. Also, one might use a plurality of electric appliances by using a multi-tap outlet other than the burial type outlets.

However, since a conventional outlet has an earth terminal hole that is always opened, children may insert conductors such as metal chopsticks into I-shaped insertion holes, to thereby cause a number of problems of leading to an electric shock accident, as well as filling the I-shaped insertion holes, or damaging internal outlet terminals to thus make it difficult to use the outlet.

In addition, foreign materials such as dust are introduced into the outlet through the opened earth terminal hole, and thus people are always exposed to risks of electric shock accidents due to a short circuit.

Thus, an outlet that blocks insertion holes of an outlet when the outlet is not in use, has been developed. Thus, electric shock accidents due to insertion of chopsticks into opened insertion holes by children may be prevented to some degrees when the outlet is not in use. However, since rotating plates that block the insertion holes of the outlet and the earth terminal hole are exposed, there may be a probability that children may happen to insert things into the insertion holes in the case that the rotating plates are made to rotate to cause the insertion holes to be opened. As a result, the conventional outlet does not fully overcome the problems such as the danger of electric shocks and damage to the outlet.

As the conventional art, the Korean Patent Application Publication No. 10-1996-0036207 published on Oct. 28, 1996, discloses a safe outlet, in which the insertion holes of the outlet are maintained to be closed when the outlet is not in use and to be opened only when the outlet is in use, and which includes: a cover in which plug insertion holes are formed; a plate that is coupled at a predetermined interval on a back surface of the cover and has communication holes that are aligned with the insertion holes of the cover; an opening and closing plate that is inserted slidably between the cover and the plate, and has a pair of pin holes through which connecting pins of the plug can be fitted, in which the opening and closing plate can move between a locking position where the pin holes are displaced from the insertion holes of the outlet and an opening position where the pin holes are aligned with the insertion holes of the outlet; a guide support unit that contacts the outer circumference of the opening and closing plate for restricting a moving direction and a moving range of the opening and closing plate; a movement control unit that allows the rotating motion of the opening and closing plate and the linear motion of the opening and closing plate when the opening and closing plate is in the locking position; and an elastic support unit that allows the opening and closing plate to return to the locking position. In the case of the safe outlet disclosed in the Korean Patent Application Publication No. 10-1996-0036207, the insertion holes of the outlet are selectively opened and the insertion holes of the outlet and the earth terminal hole are always isolated from the outside when the outlet is not in use, to thereby prevent electric shock accidents that occur by children due to the outlet in advance. However, in the case of the safe outlet disclosed in the Korean Patent Application Publication No. 10-1996-0036207, it is difficult for users to rotate the opening and closing plate to thus decrease usability of the outlet because of difficulty in inserting a plug into the outlet. As well, since the safe outlet disclosed in the Korean Patent Application Publication No. 10-1996-0036207 was developed in dedicated use for 110 V, a conventional 220 V plug cannot be inserted into the outlet.

Moreover, in the case of the conventional art safe outlet, the pin holes that are formed in the opening and closing plate and through which the plug can be inserted may be easily pushed and rotated by a chopstick or auger, to thus cause an electric shock accident, or foreign materials such as dust are introduced into the outlet through the opened earth terminal hole, to thus cause malfunction of the outlet.

In addition to the Korean Patent Application Publication No. 10-1996-0036207, as the other conventional art, there is the Korean Utility-model Registration No. 20-0192441 registered on Jun. 2, 2000 whose detailed description will be omitted for convenience of explanation.

SUMMARY OF THE INVENTION

To solve the above problems, it is an object of the present invention to provide a safe outlet that additionally includes a rotary type locking body in which the rotary type locking body is rotated to fall down, so that insertion holes and an earth terminal hole of the outlet are opened, only when a plug is plugged into the outlet, and the insertion holes and the earth terminal hole of the outlet are completely blocked when the plug is not plugged into the outlet, to thereby prevent the rotary type locking body from falling down by a locking device although children push the insertion holes and the earth terminal hole of the outlet with the finger or chopstick and to thus prevent electric shock accidents from occurring in advance and block foreign materials such as dust from being introduced into the outlet through the opened earth terminal hole.

It is another object of the present invention to provide a safe outlet having a rotary type locking body in which the rotary type locking body is rotated to fall down, so that insertion holes and an earth terminal hole of the outlet are opened, only when a plug is plugged into the outlet, and the insertion holes and the earth terminal hole of the outlet are completely blocked when the plug is not plugged into the outlet, to thereby prevent the rotary type locking body from falling down by a locking device although children push the insertion holes and the earth terminal hole of the outlet with the finger or chopstick and to thus prevent electric shock accidents from occurring in advance and block foreign materials such as dust from being introduced into the outlet through the opened earth terminal hole, to thus enable the rotary type locking body to make a smooth vertical motion since the foreign materials introduced into the outlet through the opened earth terminal hole are discharged through a foreign matter discharge hole.

According to an aspect of the present invention, there is provided a safe outlet comprising:

a power connection unit provided with an internal connecting terminal;

an outlet body that is coupled on an upper portion of the power connection unit and that is provided with an internal plug receiving portion in which socket holes are perforated on a bottom surface of the plug receiving portion;

a press plate that is positioned at an inner side of the plug receiving portion in the outlet body and that ascends and descends in the inner side of the plug receiving portion by an elasticity of a spring in which insertion holes are perforated in correspondence to the socket holes;

a cover that is coupled on top of the outlet body and prevents the press plate from being completely separated from the plug receiving portion in the outlet body; and a rotary type locking body that is provided on top of the press plate in which the insertion holes of the press plate are blocked and then a locking body cover is rotated by a pressing operation of incoming plug terminals when a plug is inserted into the outlet, to thus open the insertion holes of the press plate and make the rotary type locking body fall down and the rotary type locking body returns to an original position when the plug terminals are released from the outlet, to thus block the insertion holes of the press plate.

Preferably but not necessarily, the first coupling hole is perforated at the center of the press plate, and the rotary type locking body comprises:

a cross-shaped locking unit in which the second coupling hole is perforated in correspondence to the first coupling hole and on an outer surface of one side of which the spring coupling protrusion is protrudingly provided;

an opening and closing unit that is extended from both sides of the cross-shaped locking unit and that is located at a position corresponding to the insertion holes of the press plate;

the return spring whose one side is fitted with the spring coupling protrusion of the cross-shaped locking unit;

a rotation axis that is fitted into the first coupling hole of the press plate and the second coupling hole of the cross-shaped locking unit; and the locking body cover in which the cross-shaped locking unit is positioned and supported in the inside of the locking body cover and the one side of a return spring is supported in which the other side of the return spring is fitted with the spring coupling protrusion.

Preferably but not necessarily, a slope that is inclined in one direction is formed on the upper portion of the opening and closing unit that is extended from both sides of the cross-shaped locking unit.

Preferably but not necessarily, a locking hole is further provided on the press plate, and the locking body cover comprises:

a fastening protrusion that is coupled with the locking hole of the press plate;

a coupling pin that is fitted into a first coupling hole of the press plate and a second coupling hole of a cross-shaped locking unit when the coupling pin is located at a position corresponding to the second coupling hole of the cross-shaped locking unit;

a support piece in which the cross-shaped locking unit is positioned and with which one surface of the cross-shaped locking unit is supported in close contact;

fitting holes corresponding to the insertion holes of the press plate; and spring support pieces with which one side of a return spring is supported in close contact in which the other side of the return spring is fitted with a spring coupling protrusion of the cross-shaped locking unit.

BRIEF DESCRIPTION OF THE DRAWINGS

The above and other objects and advantages of the present invention will become more apparent by describing in detail exemplary embodiments thereof with reference to the attached drawings in which.

DETAILED DESCRIPTION OF THE INVENTION

Figure 1:
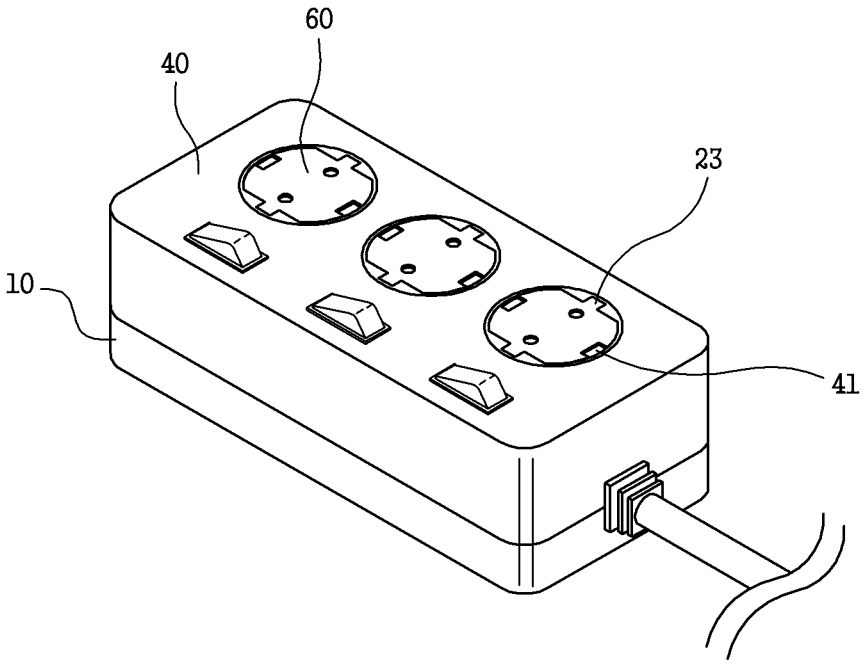
FIG. 1 is a schematic perspective view of a safe outlet according to an embodiment of the present invention.

The other objects and features in addition to the above objects of the present invention will be clearly revealed through description of preferred embodiments of the present invention with reference to the accompanying drawings.

The terms used in this application have been used for the purpose of describing particular embodiments only and are not intended to limit the present invention. Unless otherwise defined, all terms used herein, including technical or scientific terms, have the same meanings as those commonly understood by those of ordinary skill in the art to which the invention belongs. It should be interpreted that such terms as those defined in commonly used dictionaries have the meanings consistent with the sense to the context of the related art, but shall not be interpreted to have ideal or excessively formal meanings unless clearly defined in the present application.

Hereinbelow, a safe outlet according to respective embodiments of the present invention will be described in more detail with reference to the accompanying drawings. However, the present invention may be implemented in various modifications or variations, but is not limited thereto. In addition, portions that are not involved directly with the present invention are omitted to make the present invention clearer. Like reference numerals indicate like elements throughout the description of the figures.

Referring to FIGS. 1 to 5, a safe outlet according to an embodiment of the present invention includes: a power connection unit 10 provided with an internal connecting terminal 11; an outlet body 20 that is coupled on an upper portion of the power connection unit 10 and that is provided with an internal plug receiving portion 21 in which socket holes 22 are perforated on a bottom surface of the plug receiving portion 21; a press plate 30 that is positioned at an inner side of the plug receiving portion 21 in the outlet body 20 and that ascends and descends in the inner side of the plug receiving portion 21 by an elasticity of a spring 31 in which insertion holes 32 are perforated in correspondence to the socket holes 22; a cover 40 that is coupled on top of the outlet body 20 and prevents the press plate 30 from being completely separated from the plug receiving portion 21 in the outlet body 20; and a rotary type locking body 50 that is provided on top of the press plate 30 in which the insertion holes 32 of the press plate 30 are blocked and then a locking body cover 60 is rotated by a pressing operation of incoming plug terminals 101 when a plug is inserted into the outlet, to thus open the insertion holes 32 of the press plate 30 and make the rotary type locking body 50 fall down and the rotary type locking body 50 returns to an original position when the plug terminals 101 are released from the outlet, to thus block the insertion holes 32 of the press plate 30.

Figure 2:
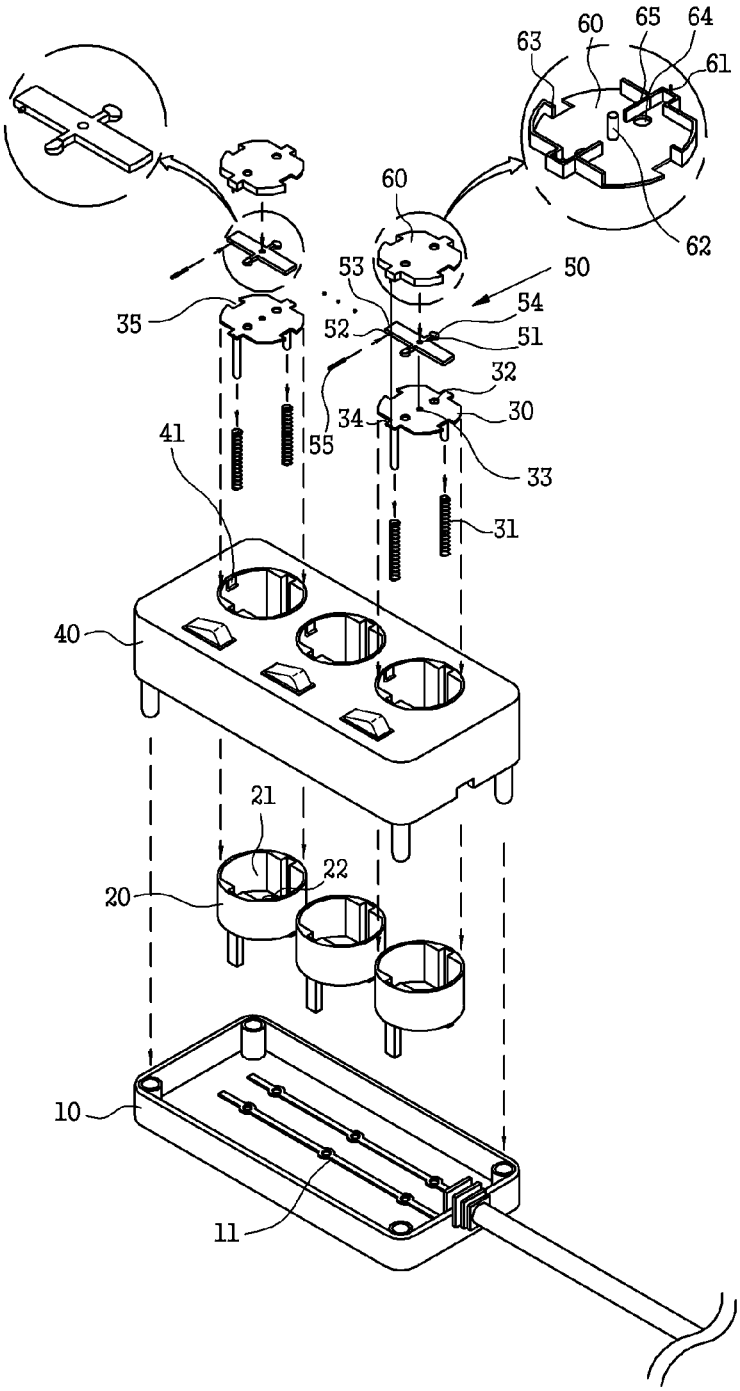
FIG. 2 is an exploded perspective view schematically illustrating the safe outlet according to an embodiment of the present invention.
Figure 3:
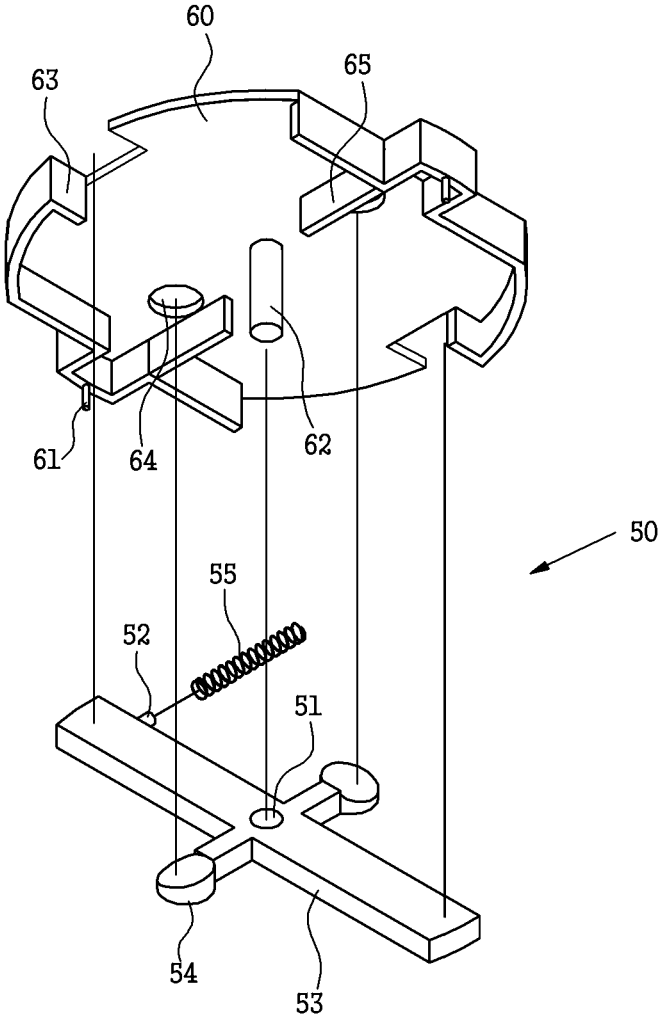
FIG. 3 is an exploded perspective view schematically illustrating essential elements of the safe outlet according to an embodiment of the present invention.
Figure 4:
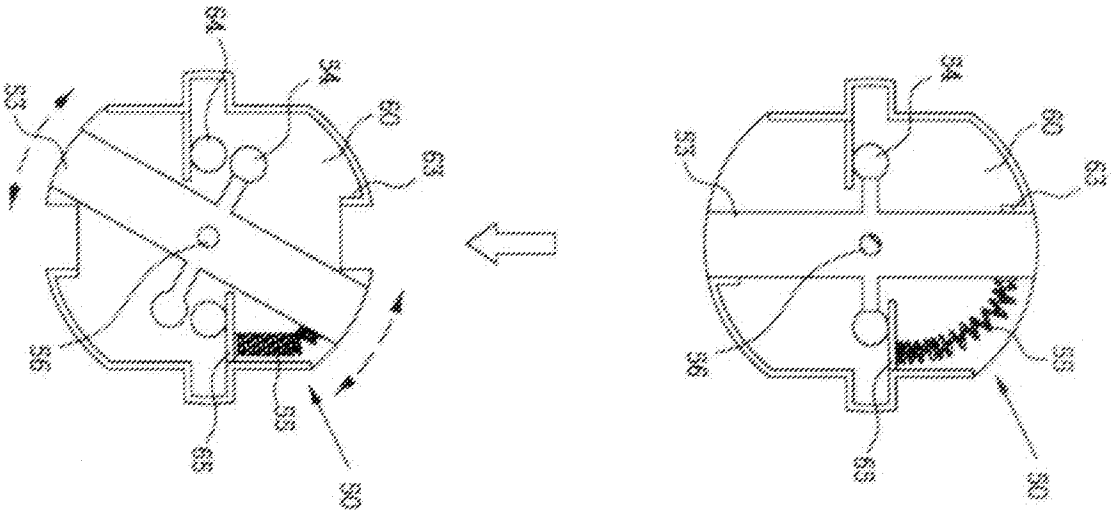
FIG. 4 is a conceptual block diagram schematically illustrating an example of a safe outlet according to an embodiment of the present invention.
Figure 6:
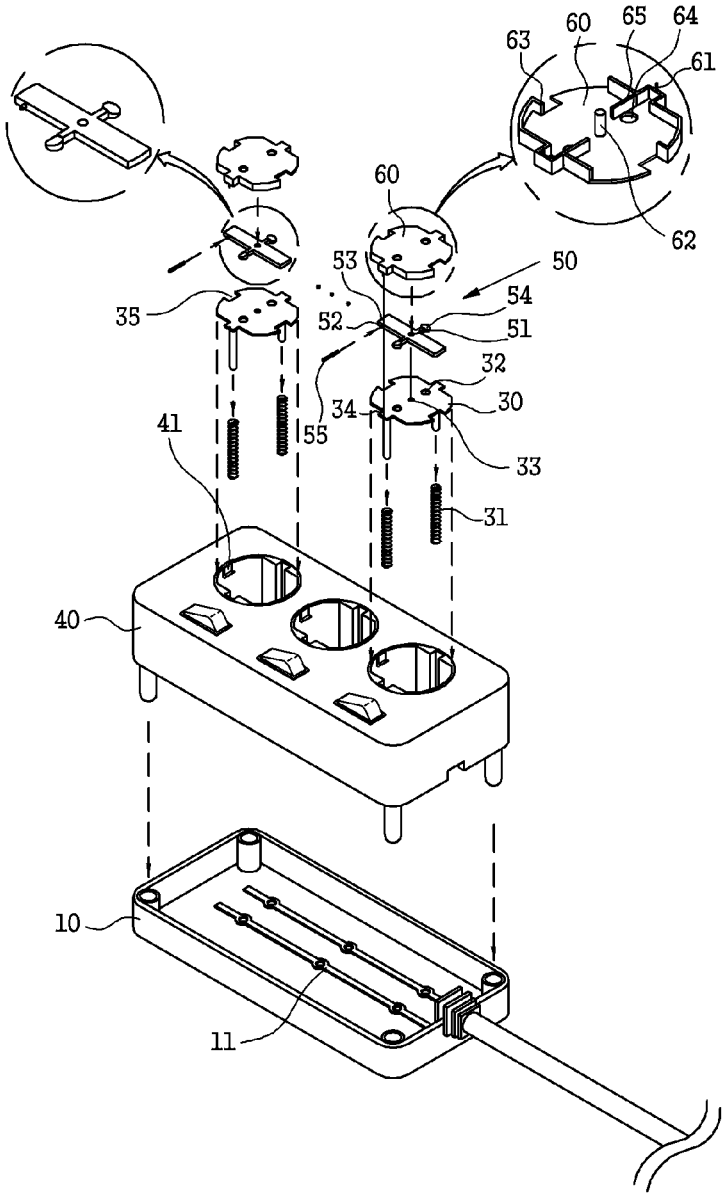
FIG. 6 is an exploded perspective view schematically illustrating a safe outlet according to another embodiment of the present invention.
Figure 7:
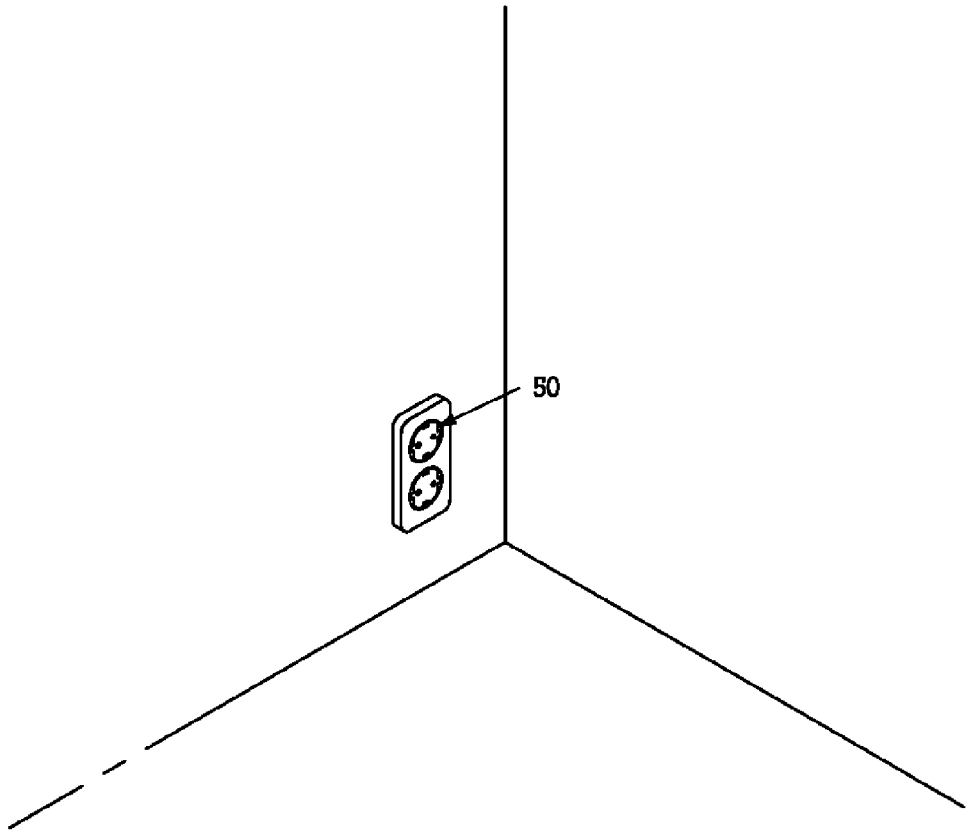
FIG. 7 is a schematic perspective view of a safe outlet that is buried on a wall according to another embodiment of the present invention.

According to the embodiment of the present invention as constructed above, when the plug terminals 101 are inserted into the outlet body 20, electricity is supplied through the plug terminals 101 to an electric appliance that needs the electricity. The safe outlet may be implemented into an adaptor type outlet as shown in FIGS. 1 and 2, or may be implemented into a wall-mount type outlet as shown in FIGS. 6 and 7. In other words, the safe outlet according to the present invention may be implemented in various forms. In the case of the safe outlet according to the present invention, users can insert plug terminals 101 into the outlet body 20 in the safe outlet only when the plug terminals 101 are made to pass through the rotary type locking body 50 during plugging the plug terminals 101 into the outlet body 20, and thus electric shock accidents can be prevented due to the play of children. In addition, prior to plugging the plug terminals 101 into the outlet body 20, the socket holes 22 of the outlet body 20 and the earth terminal hole 35 are blocked by the cross-shaped locking unit 53, and thus foreign substances such as external dust are prevented from entering the outlet. Further, foreign substances such as dust that may enter the outlet, are exited via a foreign matter discharge hole 23.

Furthermore, the cross-shaped locking unit 53 is rotated by plugging or unplugging the plug terminals 101 into and from the outlet according to the present invention, and thus the insertion holes 32 and the earth terminal hole 35 return to be blocked and opened. In addition, the rotary type locking body 50 is compulsively pressed, and thus locked, to thereby greatly enhance usability and stability.

In addition, the first coupling hole 33 is perforated at the center of the press plate 30, and the rotary type locking body 50 includes: a cross-shaped locking unit 53 in which the second coupling hole 51 is perforated in correspondence to the first coupling hole 33 and on an outer surface of one side of which the spring coupling protrusion 52 is protrudingly provided; an opening and closing unit 54 that is extended from both sides of the cross-shaped locking unit 53 and that is located at a position corresponding to the insertion holes 32 of the press plate 30; the return spring 55 whose one side is fitted with the spring coupling protrusion 52 of the cross-shaped locking unit 53; a rotation axis 56 that is fitted into the first coupling hole 33 of the press plate 30 and the second coupling hole 51 of the cross-shaped locking unit 53; and the locking body cover 60 in which the cross-shaped locking unit 53 is positioned and supported in the inside of the locking body cover 60 and the one side of a return spring 55 is supported in which the other side of the return spring 55 is fitted with the spring coupling protrusion 52. Accordingly, when the plug terminals 101 are pushed toward the locking body cover 60 by a user to thus press the opening and closing unit 54 of the cross-shaped locking unit 53, the cross-shaped locking unit 53 is rotated in one direction around the rotation axis 56 due to the press of the opening and closing unit 54.

Figure 5:
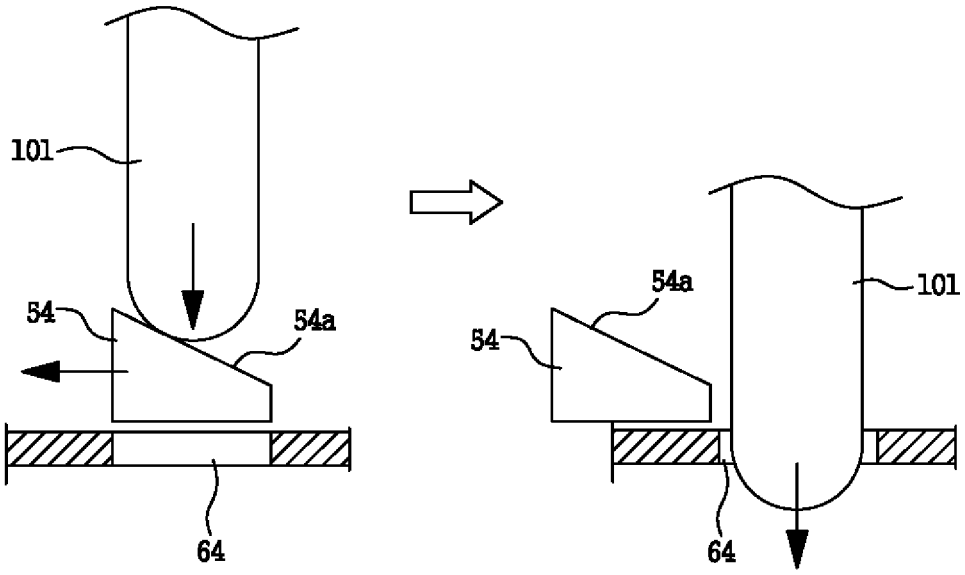
FIG. 5 is a conceptual block diagram schematically illustrating an operational relationship of a cross-shaped locking unit of a safe outlet according to an embodiment of the present invention.

In addition, the cross-shaped locking unit 53 is rotated to then get off a locking jaw 41 and release a locking operation. Further, the opening and closing unit 54 extended from both sides of the cross-shaped locking unit 53 gets off from the insertion holes 32 of the press plate 30, and thus the insertion holes 32 of the press plate 30 are opened. Here, when a user continues to press the plug terminals 101, the rotary type locking body 50 falls down and the plug terminals 101 are plugged into the opened insertion holes 32. As a result, the plug terminals 101 are plugged into the socket holes 22, and thus are electrically connected to the connecting terminal 11 of the power connection unit 10. Here, since the opening and closing unit 54 of the cross-shaped locking unit 53 is positioned at the upper portions of the insertion holes 32 of the press plate 30 as shown in FIG. 5, in the case of the cross-shaped locking unit 53 prior to the incoming of the plug terminals 101, the insertion holes 32 are blocked.

In addition, the plug terminals 101 are pushed and are rotated around the rotation axis 56 by an inclined surface of the opening and closing unit 54, and thus the extended cross-shaped locking unit 53 is rotated. Accordingly, the cross-shaped locking unit 53 that is position at the upper portion of the locking jaw 41 is also rotated, and thus the earth terminal hole 35 is opened. As a result, the rotary type locking body 50 is lowered and the plug terminals 101 continue to be pushed, to thereby make it possible to perform a plugging operation of the plug terminals 101 and the socket holes 22.

A slope 54*a* that is inclined in one direction is formed on the upper portion of the opening and closing unit 54 that is extended from both sides of the cross-shaped locking unit 53.

As a result, when the opening and closing unit 54 of the cross-shaped locking unit 53 is pressed by the plug terminals 101, the plug terminals 101 are slipped from the slope 54*a* of the opening and closing unit 54 in the pressing direction of the plug terminals 101, and thus the cross-shaped locking unit 53 from both sides of which the opening and closing unit 54 is extended is possibly rotated around the rotation axis 56.

Meanwhile, a locking hole 34 is further provided on the press plate 30, and the locking body cover 60 includes: a fastening protrusion 61 that is coupled with the locking hole 34 of the press plate 30; a coupling pin 62 that is fitted into a first coupling hole 33 of the press plate 30 and a second coupling hole 51 of a cross-shaped locking unit 53 when the coupling pin 62 is located at a position corresponding to the second coupling hole 51 of the cross-shaped locking unit 53; a support piece 63 in which the cross-shaped locking unit 53 is positioned and with which one surface of the cross-shaped locking unit 53 is supported in close contact; fitting holes 64 corresponding to the insertion holes 32 of the press plate 30; and spring support pieces 65 with which one side of a return spring 55 is supported in close contact in which the other side of the return spring 55 is fitted with a spring coupling protrusion 52 of the cross-shaped locking unit 53.

Accordingly, the plug terminals 101 are inserted through the fitting holes 64 of the locking body cover 60, and then contact the opening and closing unit 54 of the cross-shaped locking unit 53. Here, when the plug terminals 101 continue to be pressed, the cross-shaped locking unit 53 is rotated in one direction, to thus open the insertion holes 32 and the earth terminal hole 35 of the press plate 30 that is blocked by the opening and closing unit 54.

In addition, the cross-shaped locking unit 53 that is locked by the locking jaw 41 is rotated and thus opened, to thereby make the rotary type locking body 50 fall down. Here, both sides of the return spring 55 are in close contact with the spring support pieces 65 and the spring coupling protrusion 52 of the cross-shaped locking unit 53, respectively. Accordingly, when the cross-shaped locking unit 53 is rotated, the return spring 55 is naturally pressed. Thus, when the plug terminals 101 are unplugged from the outlet by a user, the pressed return spring 55 returns to an original position. Accordingly, the cross-shaped locking unit 53 that has been rotated by the return force of the return spring 55 returns to an original position, that is, a position at which the cross-shaped locking unit 53 has been plugged in which the plug terminals 101 have been locked by the locking jaw 41, to thereby block the insertion holes 32 and the earth terminal hole 35 of the press plate 30 again. As a result, although the rotary type locking body 50 is pressed by the hand or auger, the rotary type locking body 50 does not fall down, but when the plug terminals 101 are plugged into the outlet, the rotary type locking body 50 falls down, to accordingly open the insertion holes 32 and the earth terminal hole 35 of the press plate 30 and thus connect with a power source. Accordingly, foreign substances such as external dust can be prevented from entering the outlet.

FIGS. 6 and 7 illustrate a wall-mount type safe outlet according to another embodiment of the present invention. The wall-mount type safe outlet according to another embodiment of the present invention of FIGS. 6 and 7 is the same as the adaptor type safe outlet of FIGS. 1 and 2, but the former differs from the latter in a point of view that the outlet body and the power connection unit 10 of FIG. 6 are buried in a wall. Besides, since all components of FIGS. 6 and 7 are same as those of FIGS. 1 and 2, the detailed description of FIGS. 6 and 7 will be omitted.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

According to effects of the invention, when the plug terminals 101 are plugged into the fitting holes of the locking body cover, the cross-shaped locking unit 53 of the rotary type locking body is rotated and thus the plug terminals 101 are inserted toward the socket holes, but when the plug terminals 101 are unplugged from the fitting holes of the locking body cover, the cross-shaped locking unit 53 of the rotary type locking body returns to an original position, to thereby block the fitting holes and the earth terminal hole and lock the rotary type locking body so that the rotary type locking body does not fall down compulsively. Accordingly, electric shock accidents can be prevented from occurring in advance and foreign materials such as dust can be blocked from being introduced into the outlet. Further, the rotary type locking body can make a smooth vertical motion since the foreign materials introduced into the outlet through the opened earth terminal hole are discharged through a foreign matter discharge hole.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A safe outlet comprising:

a power connection unit provided with an internal connecting terminal;

an outlet body that is coupled on an upper portion of the power connection unit and that is provided with an internal plug receiving portion in which socket holes are perforated on a bottom surface of the plug receiving portion;

a press plate that is positioned at an inner side of the plug receiving portion in the outlet body and that ascends and descends in the inner side of the plug receiving portion by an elasticity of a spring in which insertion holes are perforated in correspondence to the socket holes;

a cover that is coupled on top of the outlet body and prevents the press plate from being completely separated from the plug receiving portion in the outlet body; and a rotary type locking body that is provided on top of the press plate in which the insertion holes of the press plate are blocked and then a locking body cover is rotated by a pressing operation of incoming plug terminals when a plug is inserted into the outlet, to thus open the insertion holes of the press plate and make the rotary type locking body fall down and the rotary type locking body returns to an original position when the plug terminals are released from the outlet, to thus block the insertion holes of the press plate, wherein a locking hole is further provided on the press plate, and wherein the locking body cover comprises:

a fastening protrusion that is coupled with the locking hole of the press plate;

a coupling pin that is fitted into a first coupling hole of the press plate and a second coupling hole of a cross-shaped locking unit when the coupling pin is located at a position corresponding to the second coupling hole of the cross-shaped locking unit;

a support piece in which the cross-shaped locking unit is positioned and with which one surface of the cross-shaped locking unit is supported in close contact;

fitting holes corresponding to the insertion holes of the press plate; and spring support pieces with which one side of a return spring is supported in close contact in which the other side of the return spring is fitted with a spring coupling protrusion of the cross-shaped locking unit.

2. The safe outlet according to claim 1, wherein the first coupling hole is perforated at the center of the press plate, and wherein the rotary type locking body comprises:

the cross-shaped locking unit in which the second coupling hole is perforated in correspondence to the first coupling hole and on an outer surface of one side of which the spring coupling protrusion is protrudingly provided;

an opening and closing unit that is extended from both sides of the cross-shaped locking unit and that is located at a position corresponding to the insertion holes of the press plate;

the return spring whose one side is fitted with the spring coupling protrusion of the cross-shaped locking unit;

a rotation axis that is fitted into the first coupling hole of the press plate and the second coupling hole of the cross-shaped locking unit; and the locking body cover in which the cross-shaped locking unit is positioned and supported in the inside of the locking body cover and the one side of the return spring is supported in which the other side of the return spring is fitted with the spring coupling protrusion.

3. The safe outlet according to claim 2, wherein a slope that is inclined in one direction is formed on the upper portion of the opening and closing unit that is extended from both sides of the cross-shaped locking unit.

* * * * *